US011155000B1

(12) United States Patent
Yu

(10) Patent No.: US 11,155,000 B1
(45) Date of Patent: Oct. 26, 2021

(54) CHOPPING MACHINE

(71) Applicant: Yang Bey Industrial Co., Ltd., Taichung (TW)

(72) Inventor: Teng-Chi Yu, Taichung (TW)

(73) Assignee: Yang Bey Industrial Co., Ltd., Taichung (TW)

( * ) Notice: Subject to any disclaimer, the term of this patent is extended or adjusted under 35 U.S.C. 154(b) by 0 days.

(21) Appl. No.: 16/858,730

(22) Filed: Apr. 27, 2020

(51) Int. Cl.

| | |
|---|---|
| ***B26D 1/38*** | (2006.01) |
| ***B26D 1/03*** | (2006.01) |
| ***B26D 7/06*** | (2006.01) |
| ***B26D 1/36*** | (2006.01) |
| *B26D 1/00* | (2006.01) |

(52) U.S. Cl.
CPC ..... *B26D 1/385* (2013.01); *B26D 1/035* (2013.01); *B26D 1/365* (2013.01); *B26D 7/06* (2013.01); *B26D 1/0006* (2013.01); *B26D 2001/0033* (2013.01)

(58) Field of Classification Search
CPC ..... B26D 1/385; B26D 1/035; B26D 7/06; B26D 1/365; B26D 1/0006; B26D 2001/0033; B02C 18/14; B02C 18/22
See application file for complete search history.

(56) References Cited

U.S. PATENT DOCUMENTS

| | | | | |
|---|---|---|---|---|
| 2,399,529 | A * | 4/1946 | Willits | B26D 3/02 83/341 |
| 4,474,336 | A * | 10/1984 | Fleming | A01F 29/095 241/221 |
| 5,001,952 | A * | 3/1991 | Myogadani | B26D 1/385 83/342 |
| 5,199,654 | A * | 4/1993 | Fulghum, Sr. | B02C 18/2216 144/162.1 |
| 7,434,755 | B2 * | 10/2008 | Bridge | A22C 9/004 241/282 |
| 2006/0266859 | A1 * | 11/2006 | Roberts | B02C 18/14 241/277 |
| 2009/0005231 | A1 * | 1/2009 | Silvester | B04B 3/00 494/33 |

FOREIGN PATENT DOCUMENTS

RU 1812952 A3 * 4/1993

* cited by examiner

*Primary Examiner* — Stephen Choi
(74) *Attorney, Agent, or Firm* — Bruce Stone LLP; Joseph A. Bruce

(57) ABSTRACT

A chopping machine includes a driving unit, a cutting unit, and a conveying unit. The cutting unit has a blade shaft and an immovable blade seat. The blade shaft has a plurality of movable blades. One side of the immovable blade seat is connected with an immovable blade. The conveying unit has a feeding member. Thereby, by putting a material into the feeding member, the driving unit drives the cutting unit and links the conveying unit to run. The material is chopped by the movable blades and the immovable blade, so as to improve the safety in use and reduce the situation that the material is jammed or nipped in the feeding process, and the purpose of labor-saving and fast operation is achieved.

9 Claims, 8 Drawing Sheets

CHOPPING MACHINE

FIELD OF THE INVENTION

The present invention relates to a chopping machine, and more particularly to a chopping machine for chopping materials.

BACKGROUND OF THE INVENTION

Strips are often used for packing or fixing operations, such as iron strips, PP strips, or PET strips, etc. After use, they are bulky, causing a problem that they are difficult to recycle. In general, a chopping machine is used for cutting or chopping strips. A conventional chopping machine includes a cutting device on a machine table. The machine table is provided with a feeding device on one side of the cutting device. The feeding device has a feeding opening. When the chopping machine is in use, a material is put into the feeding opening. One end of the material is guided into the cutting device through the feeding device for cutting, so that the material is cut or chopped to complete the chopping operation.

However, although the above-mentioned chopping machine is able to chop or cut the material, it is required for the operator to hold the strip to be continuously fed into the cutting device through the feeding device for cutting. Since the feeding opening is open, the operator may place his/her hand into the feeding opening by accident, or the operator's hand may be pulled to the feeding opening and hurt by the blade because the strip is pulled and drawn by the cutting device. The fragments of the strip after being cut may be sprayed out via the feeding device, causing a problem of safety. In addition, the maintenance and replacement of the cutting device requires a considerable time. Accordingly, the inventor of the present invention has devoted himself based on his many years of practical experiences to solve these problems.

SUMMARY OF THE INVENTION

The primary object of the present invention is to provide a chopping machine, which can improve the safety in use and prevent materials to be jammed or nipped in the feeding process. It is simple and time-saving to replace blades, so as to achieve the purpose of labor-saving and fast operation.

In order to achieve the above object, a chopping machine is provided. The chopping machine comprises a base; a driving unit, disposed on the base; a cutting unit, connected to the driving unit, the cutting unit having a blade shaft and an immovable blade seat, the blade shaft having a plurality of movable blade seats, each movable blade seat being provided with a movable blade, the immovable blade seat being disposed on the base, one side of the immovable blade seat, close to the blade shaft, being provided with an immovable blade; a conveying unit, connected to the cutting unit, the conveying unit having a strip feeding shaft, a roller and a feeding member, the strip feeding shaft being sleeved with a strip feeding roller, the roller being spaced and disposed under the strip feeding roller, the feeding member including a feeding opening and a feeding passage.

The chopping machine provided by the present invention uses the conveying unit to feed the material into the cutting unit, and finally the chopped material is discharged through the discharge unit. The first cutting edge portion or the movable blades can be replaced by unscrewing the first screw members, and the second cutting edge portion or the immovable blade can be replaced by unscrewing the second screw members to loosen the pressing plate. Through the cutting angle defined between the movable blade and the immovable blade, the cutting force can be increased in a labor-saving manner, such that the service life of the movable blades and the immovable blade can be prolonged, so as to achieve the purpose of labor-saving and fast operation.

DETAILED DESCRIPTION OF THE PREFERRED EMBODIMENTS

Embodiments of the present invention will now be described, by way of example only, with reference to the accompanying drawings.

Figure 1:
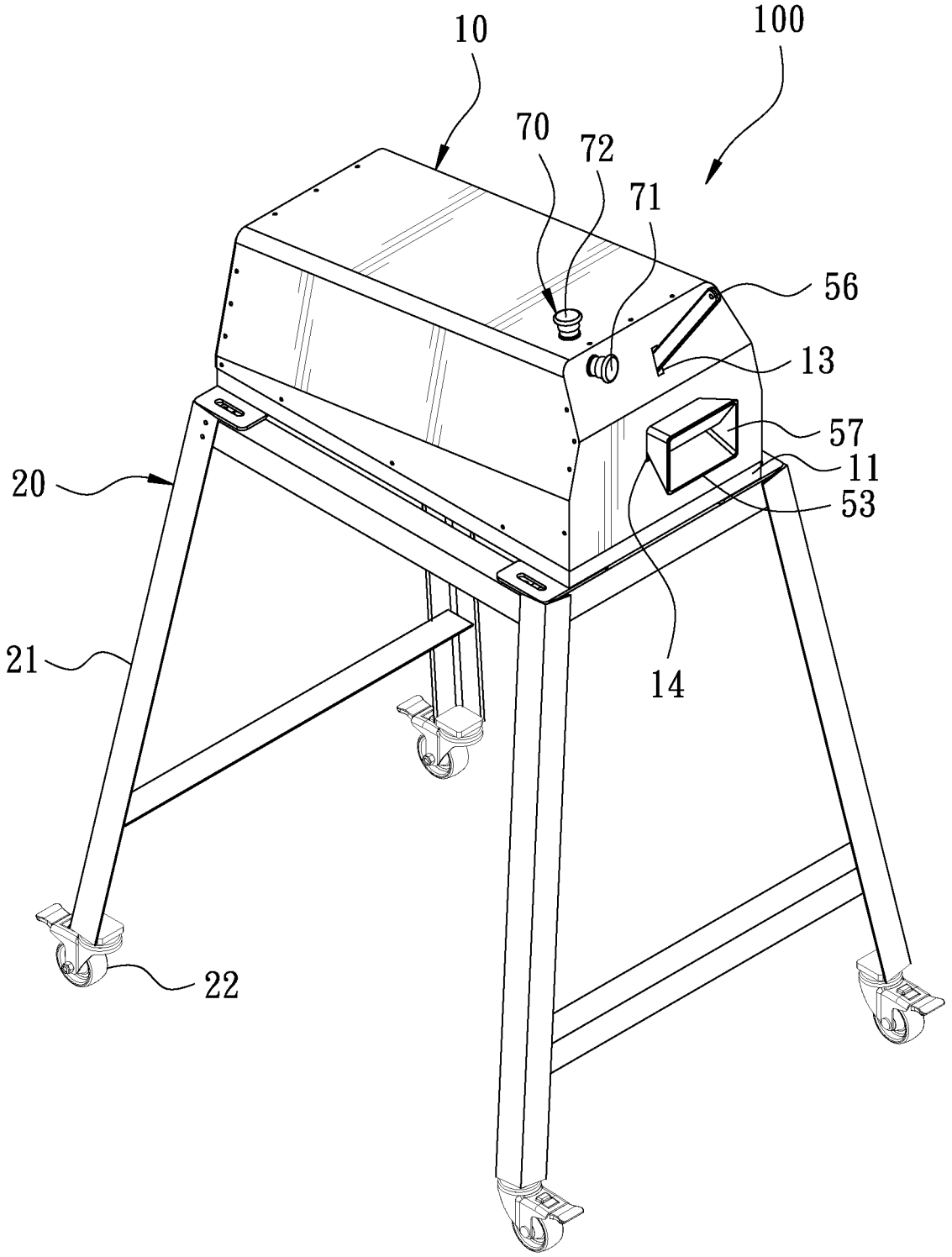
FIG. 1 is a perspective view according to a preferred embodiment of the present invention.
Figure 2:
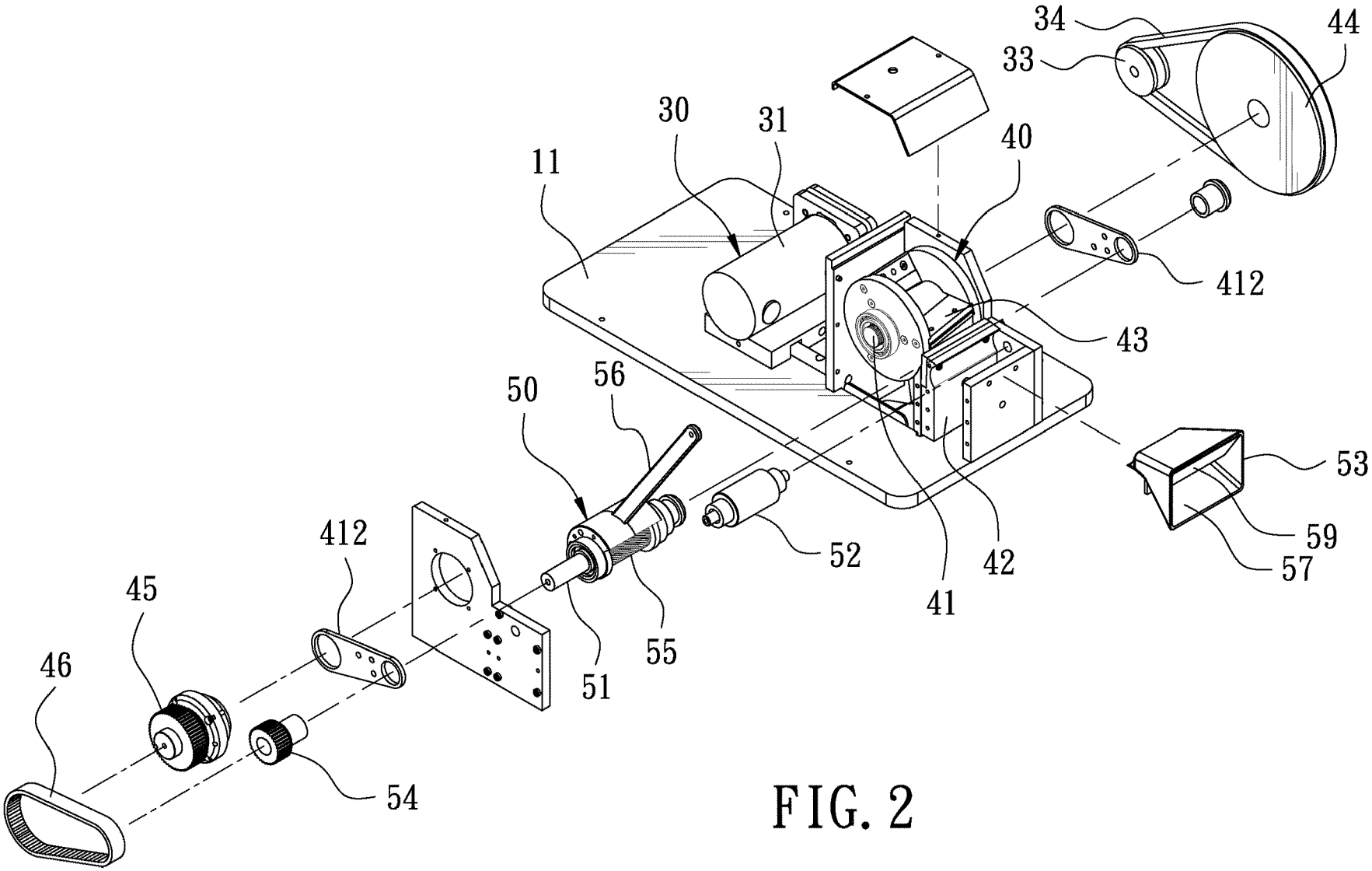
FIG. 2 is a partial exploded view according to the preferred embodiment of the present invention.
Figure 3:
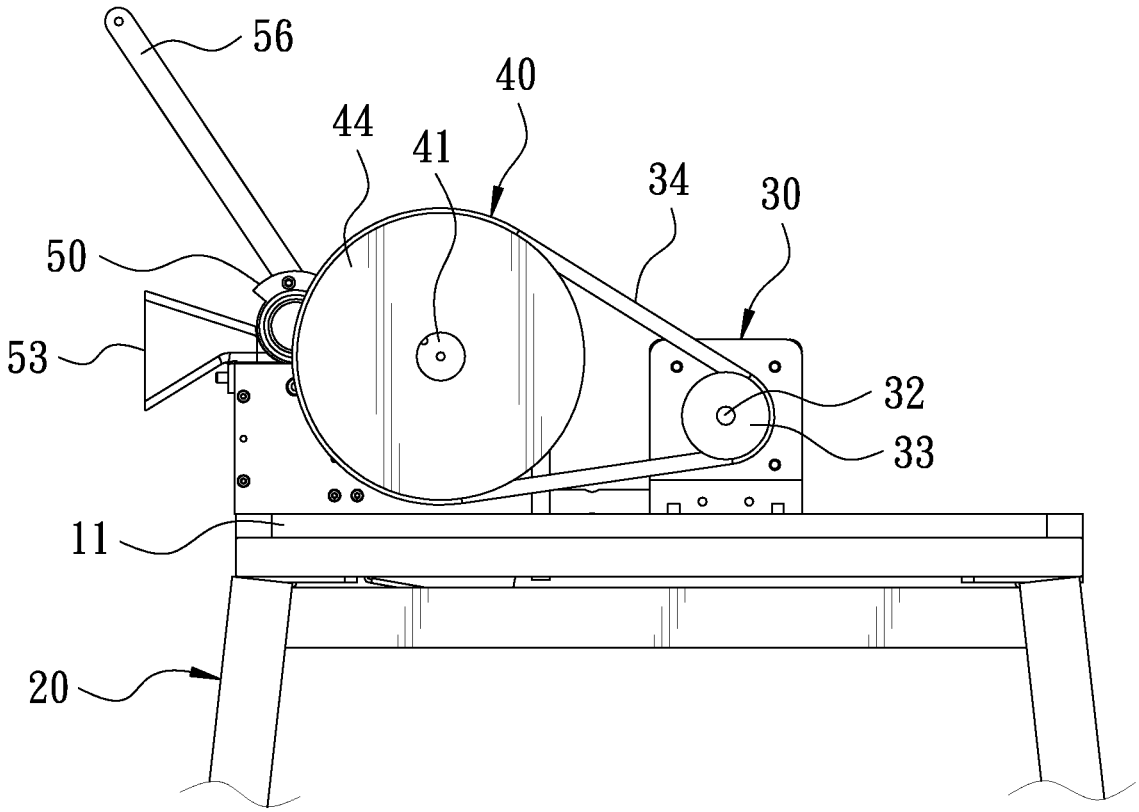
FIG. 3 is a partial side view according to the preferred embodiment of the present invention.

FIG. 1 is a perspective view according to a preferred embodiment of the present invention. FIG. 2 is a partial exploded view according to the preferred embodiment of the present invention. FIG. 3 is a partial side view according to the preferred embodiment of the present invention. The present invention discloses a chopping machine 100 for chopping materials. The materials may iron strips, PP strips, or PET strips. The chopping machine 100 comprises a casing 10, a support frame 20, a driving unit 30, a cutting unit 40, a conveying unit 50, a discharge unit 60, and a control unit 70.

The casing 10 is connected to a base 11. The base 11 has an opening 12. One side of the casing 10 has a through hole 13 and a perforation 14. In this embodiment of the invention, the through hole 13 is an elongated hole, and the perforation 14 is a rectangular hole.

The support frame 20 is disposed under the base 11. The support frame 20 has a plurality of support poles 21. The bottom of each support pole 21 is connected to a caster 22, so that the support frame 20 can be moved conveniently.

The driving unit 30 is disposed on the base 11. In this embodiment of the present invention, the driving unit 30 includes a motor 31. The motor 31 has a driving shaft 32. One end of the driving shaft 32 is connected to a driving wheel 33. A driving belt 34 is wound around the driving wheel 33.

Figure 4:
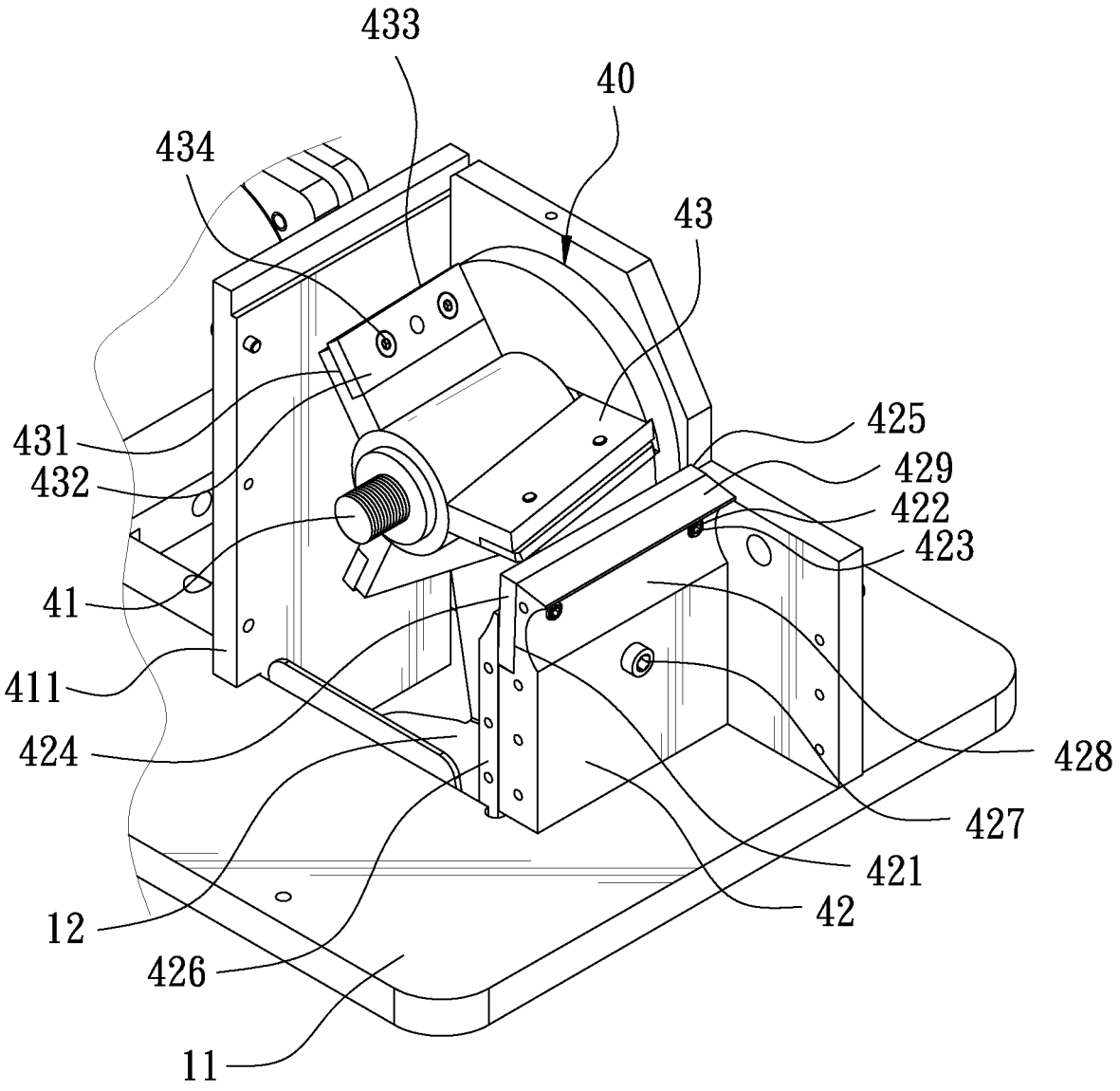
FIG. 4 is a partial perspective view of the cutting unit according to the preferred embodiment of the present invention.

FIG. 4 is a partial perspective view of the cutting unit according to the preferred embodiment of the present invention. The cutting unit 40 is disposed in the casing 10 and connected to the driving unit 30. The cutting unit 40 has a blade shaft 41 and an immovable blade seat 42. The blade shaft 41 is pivotally connected to two vertical plates 411. The two vertical plates 411 are vertically connected to the base 11. The opening 12 is located between the two vertical plates 411. The blade shaft 41 has a plurality of movable blade seats 43 arranged obliquely. A cutting angle θ is defined between each movable blade seat 43 and the axis a of the blade shaft 41. The cutting angle θ is 5-15 degrees. Preferably, the cutting angle θ is 10 degrees. Each movable blade seat 43 has a first groove 431. A movable blade 432 is secured to the first groove 431. The movable blade 432 has a plurality of first cutting edge portions 433. The movable blade 432 is connected to the corresponding movable blade seat 43 by a plurality of first screw members 434. In this embodiment of the present invention, each movable blade 432 is a rectangular blade. The four edges of each movable blade 432 have the first cutting edge portions 433, respectively. The first screw members 434 are screws. Thus, the first cutting edge portions 433 or the movable blades 432 can be replaced by screwing the first screw members 434. One end of the blade shaft 41, close to the driving wheel 33, is connected to a driven wheel 44. The driving belt 34 is wound around the driven wheel 44 and the driving wheel 33. Two ends of the blade shaft 41 are sleeved with limiting plates 412. The other end of the blade shaft 41, opposite to the driven wheel 44, is connected to a first pulley 45. The first pulley 45 is meshed with a timing belt 46. The immovable blade seat 42 is vertically connected to the base 11. One side of the immovable blade seat 42, close to the blade shaft 41, has a second groove 421. One side of the second groove 421 is provided with a plurality of screw holes 422. Each screw hole 422 is provided with an adjustment member 423. An immovable blade 424 is secured to the second groove 421. The immovable blade 424 has a plurality of second cutting edge portions 425. One side of the immovable blade seat 42, close to the blade shaft 41, is connected with a pressing plate 426. The top end of the pressing plate 426 extends to a position relative to a middle portion of the second groove 421 for pressing against a portion of the immovable blade 424. The pressing plate 426 locks the immovable blade 424 to the immovable blade seat 42 through a second screw member 427. In this embodiment of the present invention, the adjustment members 423 are screws for the immovable blade 424 to be pushed outwardly or retracted inwardly, thereby adjusting the gap between the immovable blade 424 and the movable blade 432. The immovable blade 424 is a rectangular blade. The four edges of the immovable blade 424 have the second cutting edge portions 425, respectively. The second screw member 427 is a screw. Thus, by unscrewing the second screw 427, the pressing plate 426 can be loosened to replace the second cutting edge portion 425 or the immovable blade 424. In addition, the other side of the immovable blade seat 42, facing away from the blade shaft 41, has an arc-shaped groove 428. The top of the immovable blade seat 42 has a guide bevel 429. The guide bevel 429 is inclined downward from the second groove 421 toward the arc-shaped groove 428, so as to prevent the material from being jammed or nipped in the feeding process.

The conveying unit 50 is connected to the cutting unit 40. The conveying unit 50 includes a strip feeding shaft 51, a roller 52, and a feeding member 53. Two ends of the strip feeding shaft 51 are sleeved with the limiting plates 412, respectively. One end of the strip feeding shaft 51, close to the first pulley 45, is connected to a second pulley 54. Both the second pulley 54 and the first pulley 45 are meshed with the timing belt 46. The strip feeding shaft 51 is sleeved with a strip feeding roller 55. The roller 52 is spaced and disposed under the strip feeding roller 55. A portion of the roller 52 is located in the arc-shaped groove 428. A pull lever 56 is connected to the strip feeding shaft 51. The pull lever 56 extends out of the through hole 13 of the casing 10. The feeding member 53 has a trumpet-like shape. The feeding member 53 includes a feeding opening 57 and a feeding passage 58. The feeding opening 57 is in communication with the perforation 14 of the casing 10. A limiting block 59 is provided in the feeding passage 58. The limiting block 59 has a V shape to prevent the operator's hand from entering the conveying unit 50.

Figure 6:
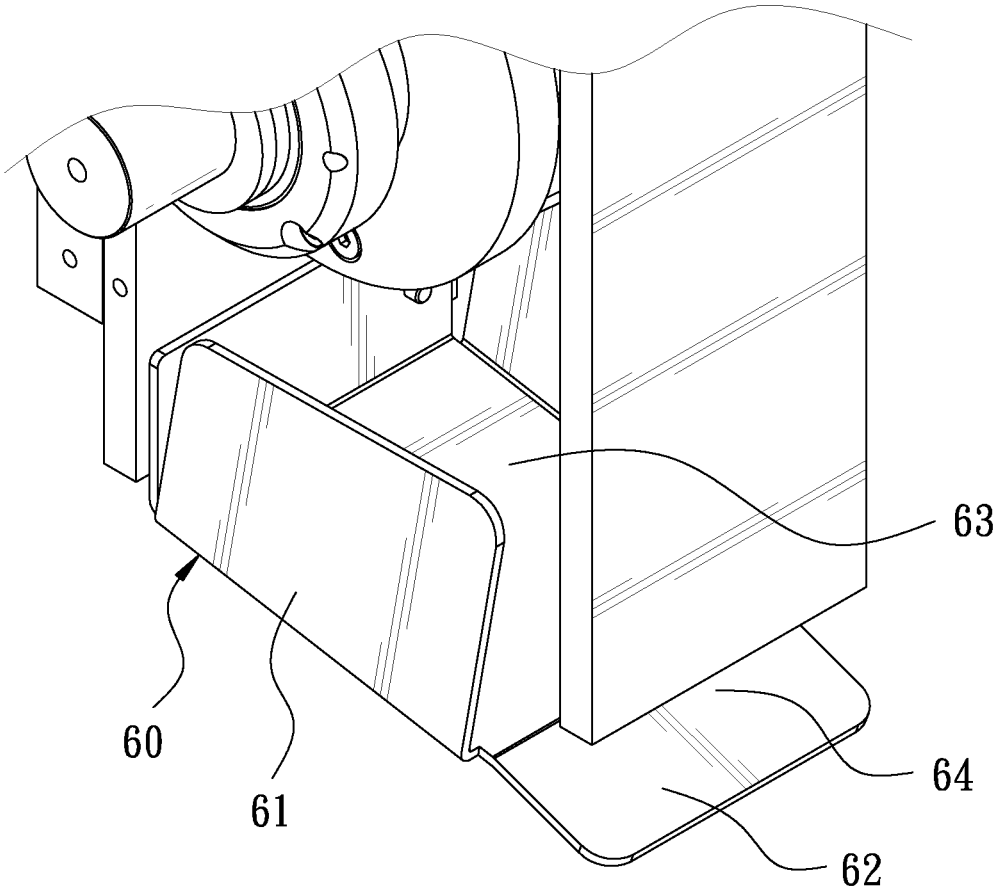
FIG. 6 is a partial perspective view according to the preferred embodiment of the present invention, illustrating the discharge unit.

FIG. 6 is a partial perspective view according to the preferred embodiment of the present invention, illustrating the discharge unit. The discharge unit 60 is disposed under the base 11. The discharge unit 60 includes three upright plates 61 and a bottom plate 62. The upright plates 61 are vertically arranged on the bottom plate 62. The opening 12 is located among the vertical plates 61. The vertical plates 61 are connected to the bottom plate 62. The bottom plate 62 is inclined downward from one side close to the conveying unit 50 toward the other side thereof. A guide groove 63 is defined and surround by the vertical plates 61 and the bottom plate 62. A discharge opening 64 is formed at the distal end of the bottom plate 62 for guiding the chopped material to be discharged.

The control unit 70 is electrically connected to the driving unit 30, the cutting unit 40, the conveying unit 50, and the discharge unit 60. The control unit 70 has a first button 71 and a second button 72. The first button 71 and the second button 72 are disposed on the casing 10 close to the through hole 13. In this embodiment of the present invention, the first button 71 is a switch button, and the second button 72 is an emergency stop button.

Figure 7:
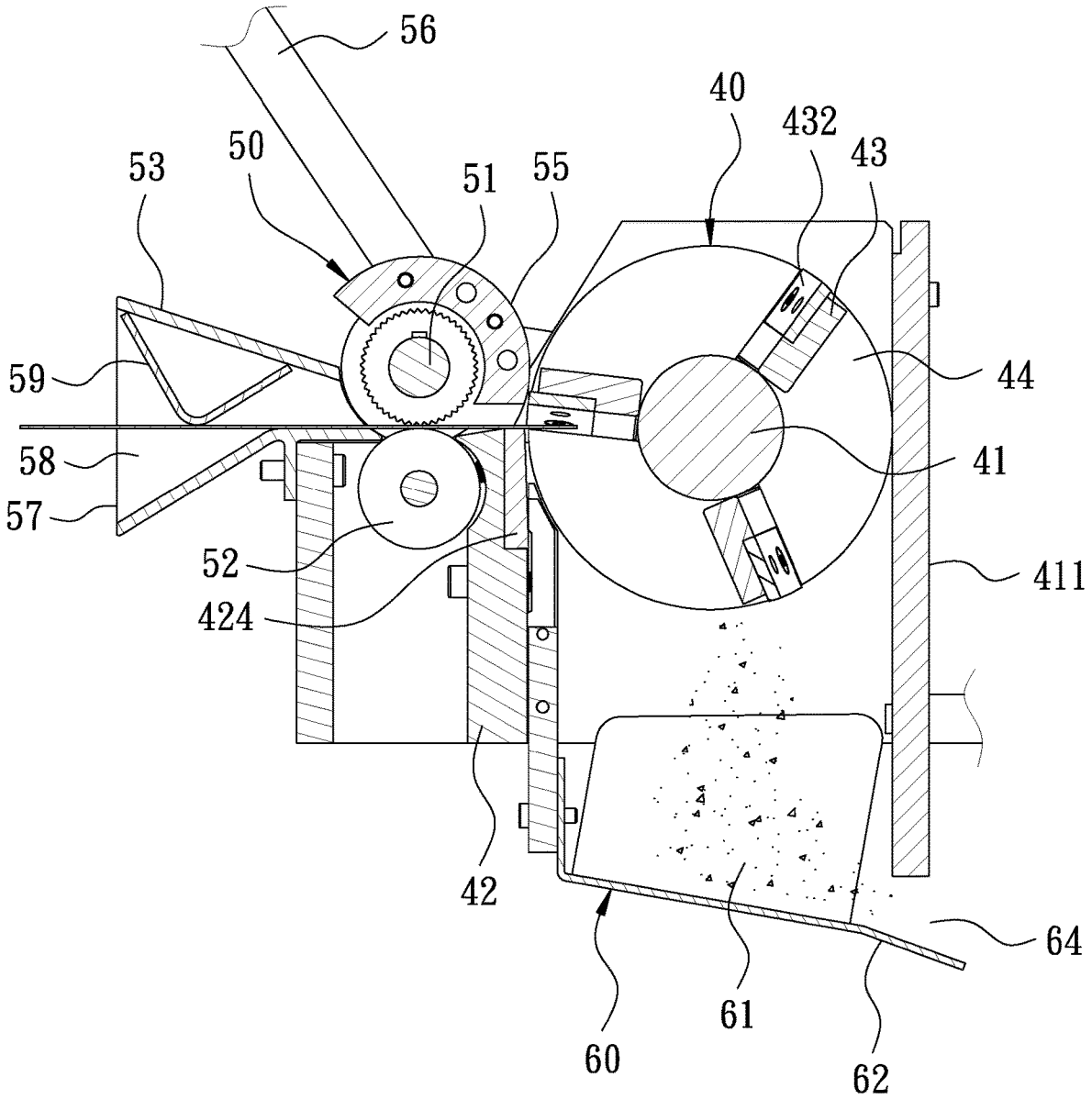
FIG. 7 is a schematic view according to the preferred embodiment of the present invention when in use.
Figure 8:
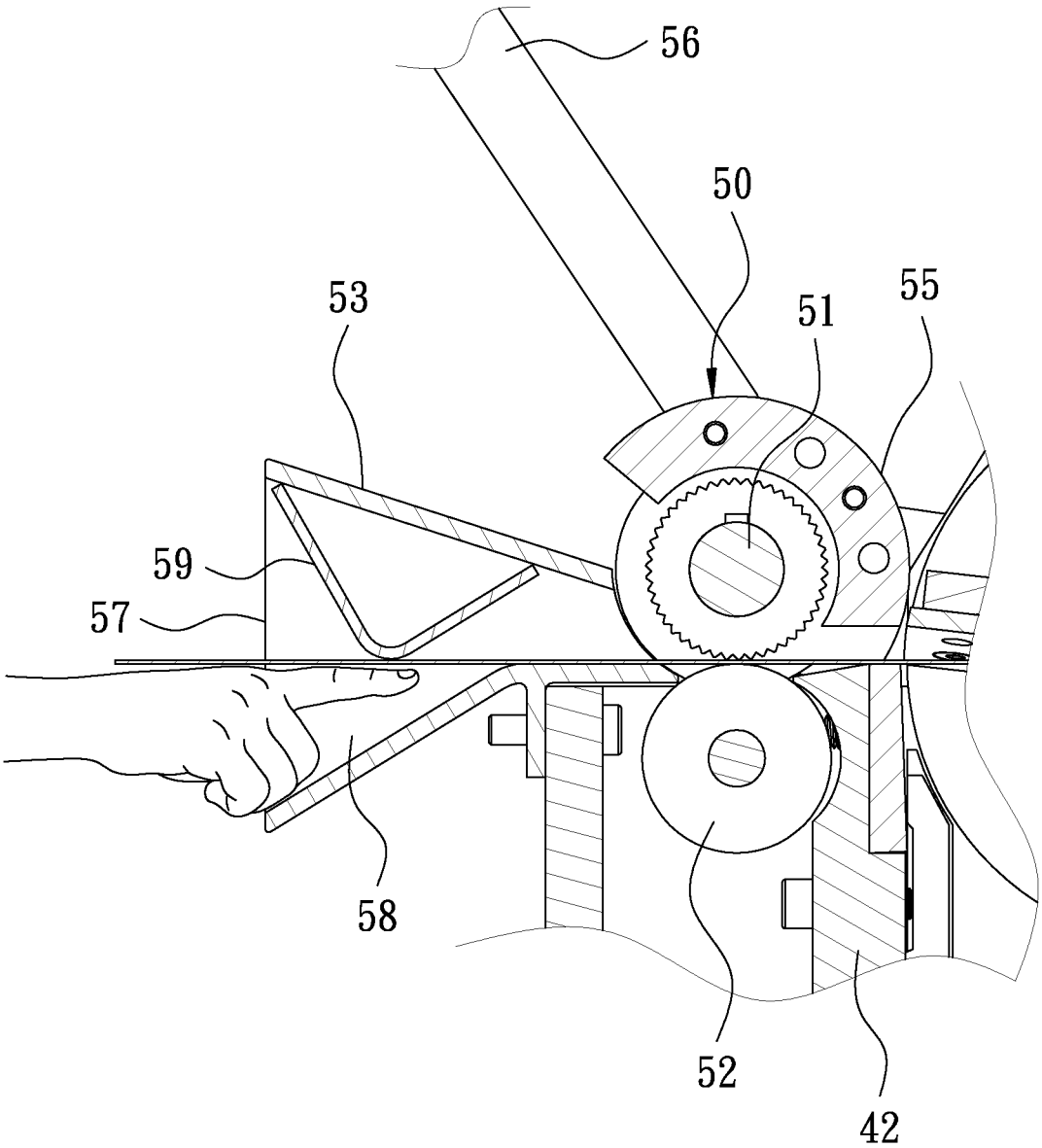
FIG. 8 is a schematic view according to the preferred embodiment of the present invention when in use, illustrating the limiting block configured to block the operator's finger.

FIG. 7 and FIG. 8 are schematic views according to the preferred embodiment of the present invention when in use. When the operator wants to chop a material, the first button 71 is first pressed to start the power supply to actuate the motor 31. The blade shaft 41 and the strip feeding roller 55 are linked to rotate through the driving belt 34 and the timing belt 46. At this time, the material to be chopped, such as iron strip, PP strip, PET strip, plastic tube or plastic pipe, etc., is put into the feeding opening 57 and pushed into the feeding passage 58. The material is moved towards the roller 52 and the strip feeding roller 55 along a straight line. Then, the strip feeding shaft 51 assists the roller 52 in moving the material to be between the blade shaft 41 and the immovable seat 42. Through the movable blades 432 of the blade shaft 41 and the cutting angle θ defined between the movable blade 432 and the immovable blade 424, the material can be chopped and fall into the guide groove 63. The vertical plates 61 and the bottom plates 62 can prevent the chopped material from being sprayed. Finally, the chopped material is discharged from the discharge opening 64, so as to complete the chopping operation.

Besides, the top of the immovable blade seat 42, close to the immovable blade 424, has the guide bevel 429, and a portion of the roller 52 is located in the arc-shaped groove 428, so that when the material passes through the strip feeding roller 55 and the roller 52, it will be guided to the cutting unit 40 by the guide bevel 429, so as to prevent the material from being jammed between the roller 52 and the arc-shaped groove 428. If the strip is jammed, the pull lever 56 can be lifted up to raise the strip feeding shaft 51 through the limiting plates 412 with the blade shaft 41 as a center, so that the operator can overcome the situation that the material is jammed or nipped. In addition, the arc-shaped groove 428 is configured to receive a portion of the roller 52, so its shape is not limited to an arc and may be triangular, rectangular or other shape.

Figure 5:
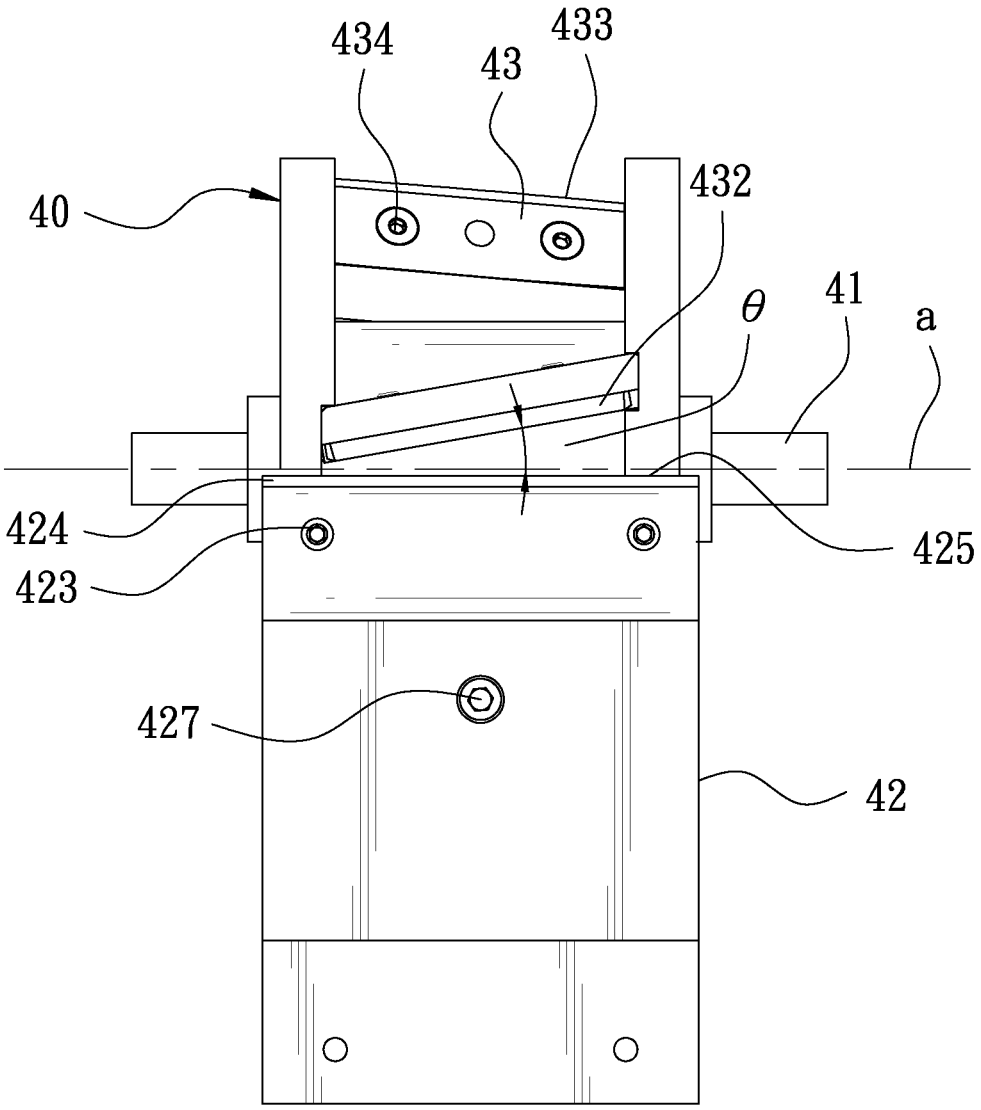
FIG. 5 is a partial side view according to the preferred embodiment of the present invention, illustrating the cutting angle.

It is worth mentioning that the cutting angle θ is defined between each movable blade seat 43 and the axis of the blade shaft 41, so that the cutting angle θ is also defined between the first cutting edge portion 433 of each movable blade 432 and the second cutting edge portion 425 of the immovable blade 424. As shown in FIG. 5, the cutting force can be increased in a labor-saving manner, such that the service life of the movable blades 432 and the immovable blade 424 can be prolonged. Besides, the pull lever 56 can push up the strip feeding shaft 51. The gap between the movable blade 432 and the immovable blade 424 can be adjusted through the adjustment member 423 for the chopping operation of various materials. By unscrewing the first screw members 434 to replace the first cutting edge portion 433 or the movable blades 432 and by unscrewing the second screw members 427 to loosen the pressing plate 426 so as to replace the second cutting edge portion 425 or the immovable blade 424, the blades can be quickly replaced, thereby increasing the service life and working efficiency of the blades.

What is claimed is:

1. A chopping machine, comprising:

a base;

a driving unit, disposed on the base;

a cutting unit, connected to the driving unit, the cutting unit having a blade shaft and an immovable blade seat, the blade shaft having a plurality of movable blade seats, each movable blade seat being provided with a movable blade, the immovable blade seat being disposed on the base, one side of the immovable blade seat, close to the blade shaft, being provided with an immovable blade;

a conveying unit, connected to the cutting unit, the conveying unit having a strip feeding shaft, a roller and a feeding member, the strip feeding shaft being sleeved with a strip feeding roller, the roller being spaced and disposed under the strip feeding roller, the feeding member including a feeding opening and a feeding passage;

wherein the driving unit includes a motor, the motor has a driving shaft, one end of the driving shaft is connected to a driving wheel, a driving belt is wound around the driving wheel, one end of the blade shaft, close to the driving wheel, is connected to a driven wheel, the driving belt is wound around the driven wheel and the driving wheel, another end of the blade shaft, opposite to the driven wheel, is connected to a first pulley, the first pulley is meshed with a timing belt, one end of the strip feeding shaft, close to the first pulley, is connected to a second pulley, both the second pulley and the first pulley are meshed with the timing belt.

2. The chopping machine as claimed in claim 1, wherein each movable blade seat has a first groove, the movable blade is secured to the first groove, the movable blade has a plurality of first cutting edge portions, the movable blade is connected to a respective one of the movable blade seats by at least one screw member, the side of the immovable blade seat, close to the blade shaft, has a second groove, the immovable blade is secured to the second groove, the immovable blade has a plurality of second cutting edge portions, and the immovable blade is locked to the immovable blade seat through at least one second screw member.

3. The chopping machine as claimed in claim 1, wherein the side of the immovable blade seat, close to the blade shaft, has a second groove, one side of the second groove is provided with at least one adjustment member, the immovable blade is secured to the second groove, the side of the immovable blade seat, close to the blade shaft, is connected with a pressing plate, a top end of the pressing plate extends to a position relative to a middle portion of the second groove for pressing against a portion of the immovable blade, the pressing plate locks the immovable blade to the immovable blade seat through at least one second screw member, and the immovable blade can be pushed outwardly or retracted inwardly by adjusting the at least one adjustment member, thereby adjusting a gap between the immovable blade and the movable blade.

4. The chopping machine as claimed in claim 1, wherein a cutting angle is defined between the movable blade and the immovable blade, and the cutting angle is 5-15 degrees.

5. The chopping machine as claimed in claim 1, wherein another side of the immovable blade seat, facing away from the blade shaft, has an arc-shaped groove, a portion of the roller is located in the arc-shaped groove, a top of the immovable blade seat has a guide bevel, and the guide bevel is inclined downward away from the immovable blade.

6. The chopping machine as claimed in claim 1, wherein a casing is connected to the base, the casing has a through hole, two ends of the blade shaft are sleeved with limiting plates respectively, two ends of the strip feeding shaft are sleeved with the limiting plates respectively, the strip feeding shaft is provided with a pull lever, and the pull lever extends out of the through hole of the casing.

7. The chopping machine as claimed in claim 1, wherein the base has an opening, the blade shaft is pivotally connected to two vertical plates, the two vertical plates are vertically connected to a top of the base, the opening is located between the two vertical plates, the chopping machine further comprises a discharge unit, the discharge unit is connected to a bottom of the base, the discharge unit includes a plurality of upright plates and a bottom plate, the upright plates are vertically arranged on the bottom plate, the opening is located among the vertical plates, the vertical plates are connected to the bottom plate, the bottom plate is inclined downward from one side close to the conveying unit toward another side thereof, a guide groove is defined and surround by the vertical plates and the bottom plate, and a discharge opening is formed at a distal end of the bottom plate.

8. The chopping machine as claimed in claim 1, wherein a casing is connected to the base, the casing has a perforation, the feeding member has a trumpet-like shape, the feeding opening is in communication with the perforation of the casing, a limiting block is provided in the feeding passage, and the limiting block has a V shape.

9. The chopping machine as claimed in claim 1, further comprising a support frame disposed under the base, the support frame having a plurality of support poles, a bottom of each support pole being connected to a caster.

* * * * *